US005444943A

United States Patent [19]

Schelfhorst

[11] Patent Number: 5,444,943

[45] Date of Patent: Aug. 29, 1995

[54] ROOF FOR A SILO OR THE LIKE

[76] Inventor: Hendrik W. Schelfhorst, Eerbeek 2, Zwolle NL-8033 BJ, Netherlands

[21] Appl. No.: 184,737

[22] Filed: Jan. 21, 1994

Related U.S. Application Data

[63] Continuation of Ser. No. 63,117, May 17, 1993, abandoned, which is a continuation of Ser. No. 800,984, Dec. 2, 1991, abandoned.

[30] Foreign Application Priority Data

Jun. 21, 1991 [EP] European Pat. Off. ..... 91201603

[51] Int. Cl.[6] ..... E04B 7/00

[52] U.S. Cl. ..... 52/63; 52/83; 52/82; 52/192; 52/222

[58] Field of Search ..... 52/63, 82, 83, 117, 52/118, 192, 193, 222; 135/98-100

[56] References Cited

U.S. PATENT DOCUMENTS

| | | | |
|---|---|---|---|
| 459,644 | 9/1891 | McCandless | 135/98 X |
| 519,178 | 5/1894 | Douglas et al. | 135/98 X |
| 707,123 | 8/1902 | Lacey et al. | 52/193 |
| 741,403 | 10/1903 | Hubbard | 52/192 |
| 1,825,800 | 10/1931 | Houseman | 52/83 X |
| 3,153,302 | 10/1964 | Wheeler | 52/82 X |
| 3,521,416 | 7/1970 | Joor, II | 52/222 |
| 3,738,378 | 6/1973 | Williams | 135/98 |
| 3,929,146 | 12/1975 | Maiken | 135/98 |
| 4,581,860 | 4/1986 | Berger | 52/83 X |
| 4,757,650 | 7/1988 | Berger | 52/83 X |

FOREIGN PATENT DOCUMENTS

| | | | |
|---|---|---|---|
| 1207973 | 7/1986 | Canada . | |
| 0192308 | 8/1986 | European Pat. Off. . | |
| 1147717 | 11/1957 | France . | |
| 2153675 | 5/1973 | France . | |
| 2638290 | 6/1977 | Germany | 52/83 |
| 400505 | 4/1966 | Switzerland . | |
| 0605917 | 6/1978 | U.S.S.R. | 52/83 |
| 1234549 | 6/1986 | U.S.S.R. | 52/83 |

*Primary Examiner*—Carl D. Friedman
*Assistant Examiner*—Robert J. Canfield
*Attorney, Agent, or Firm*—Willian Brinks Hofer Gilson & Lione

[57] ABSTRACT

Roof for a storage reservoir, such as a silo, having a frame with a rigid peripheral element, a central core element and a plurality of tension elements which are distributed about the peripheral element. The central core element includes at least two supports that are mutually connected at an axial distance apart. The tension elements are stretched between each support on the central core element and the peripheral element. The tension element is fixed to the central core element and the tension element such that the tension of the frame is varied by varying the distance of the tension element is stretched between the rigid peripheral element and the central core element.

30 Claims, 5 Drawing Sheets

ROOF FOR A SILO OR THE LIKE

This application is a continuation of application of Ser. No. 08/063,117, filed May 17, 1993, which is a continuation of application of Ser. No. 07/800,984, filed Dec. 2, 1991, now both abandoned.

The invention relates to a roof for a silo or the like, comprising a frame with a closing roof covering. The frame comprises a continuous rigid peripheral element and a central core wherein a number of tensioning elements are stretched between the central core and the peripheral element. A rigidly connected unit is thus obtained.

Such a roof is known from the French patent 2 153 675. This known roof is intended to function as a floating roof, which is therefore supported over a large part of its whole surface area.

The invention has for its object to provide a roof of the present type which can span a space such as a silo and which has a simple construction.

This object is achieved with the roof according to the invention. Owing to the tensioning means which can adjustably vary the distance between the connecting point of the tensioning elements to the peripheral element and the connecting point thereof to the central core, the whole assembly can be tensioned to a rigid unit in a simple manner. An additional advantage is that all tensioning elements are uniformly tensioned.

The roof is particularly suitable for laying on the edge of a storage reservoir, in particular a silo. The roof covering can therein close the silo so it is entirely gas-tight. The roof according to the invention can thereby serve as roof for a bio-gas holder. The roof can be applied particularly well in combination with a reservoir invented by applicant which is described in the European patent application 86200240.9 with the Dutch title "Op een vaste plaats op de grond te plaatsen reservoir en werkwijze voor het vervaardigen daarvan" ("Reservoir for placing on a fixed position on the ground and method for manufacturing same"). Such reservoirs can be used inter alia as manure storage tanks. By applying the roof according to the invention in such a reservoir, stench nuisance for the surrounding area and ammonia emission can be prevented.

A favourable embodiment is characterized by a tensioning means formed by means for adjustably varying the peripheral length of the peripheral element. By enlarging the peripheral element, for example by sliding out thereof, the distance between the connecting point of the tensioning elements to the peripheral element and the connecting point thereof to the central core is enlarged, whereby the tensioning elements are placed under a greater tension. With an operation at a single location the whole state of tension of the roof can hereby be adjusted.

A suitable embodiment of the device according to the invention is characterized by having the ends of the peripheral element can slide telescopically into each other at the location of each division and carry flanges lying at a mutual distance wherein screw elements extend from one flange to the other, which screw elements carry nuts which each lie against a flange, against the face thereof facing towards the other flange. By simply constraining the flanges away from each other using the screw elements, the peripheral length of the peripheral element is enlarged and the desired tensioning effect is obtained. The step of having a sleeve arranged round the flanges and the space inside the sleeve filled with foam plastic is preferably applied here. After the roof has been set to an appropriate tension it can be finished in this way.

Another embodiment of the roof according to the invention is characterized by having a sleeve arranged round the flanges and the space inside the sleeve filled with foam plastic. By displacing the supports connected to the central core away from each other the distance of the supports to the peripheral element is enlarged, whereby the tensioning elements are placed under tension.

A favourable embodiment of this further inventive concept is characterized by having the central core having a post bearing the supports at both ends and the tensioning elements extend through guide openings in the supports to fixing elements slidable along the post and wherein the tensioning means grip onto the fixing elements in order to fix these at an adjustable distance relative to each other. The supports are herein connected fixedly to the post and the adjustability of the connecting point is achieved by sliding the fixing elements.

A further favourable development is characterized by having the fixing elements with opposing screw threads are in engagement with a screw spindle extending in the post such that by rotating the screw spindle the spacing of the fixing elements changes.

In order to provide the roof covering with a non-flap connection to the roof, according to a further favourable development of the invention the step of having at least on the top part of the roof the tensioning elements are doubled and the roof covering is arranged therebetween can be applied. The roof covering is therein enclosed in the tensioning elements so that these cannot deflect up or downward.

The tensioning elements can be manufactured in a favourable manner from polyamide strips. This material can be tensioned well and is moreover not sensitive to weather influences or adverse affected by the gases released from the material stored in the reservoir.

The invention will be elucidated further in the following description with reference to the embodiments shown in the figures.

Figure 1:
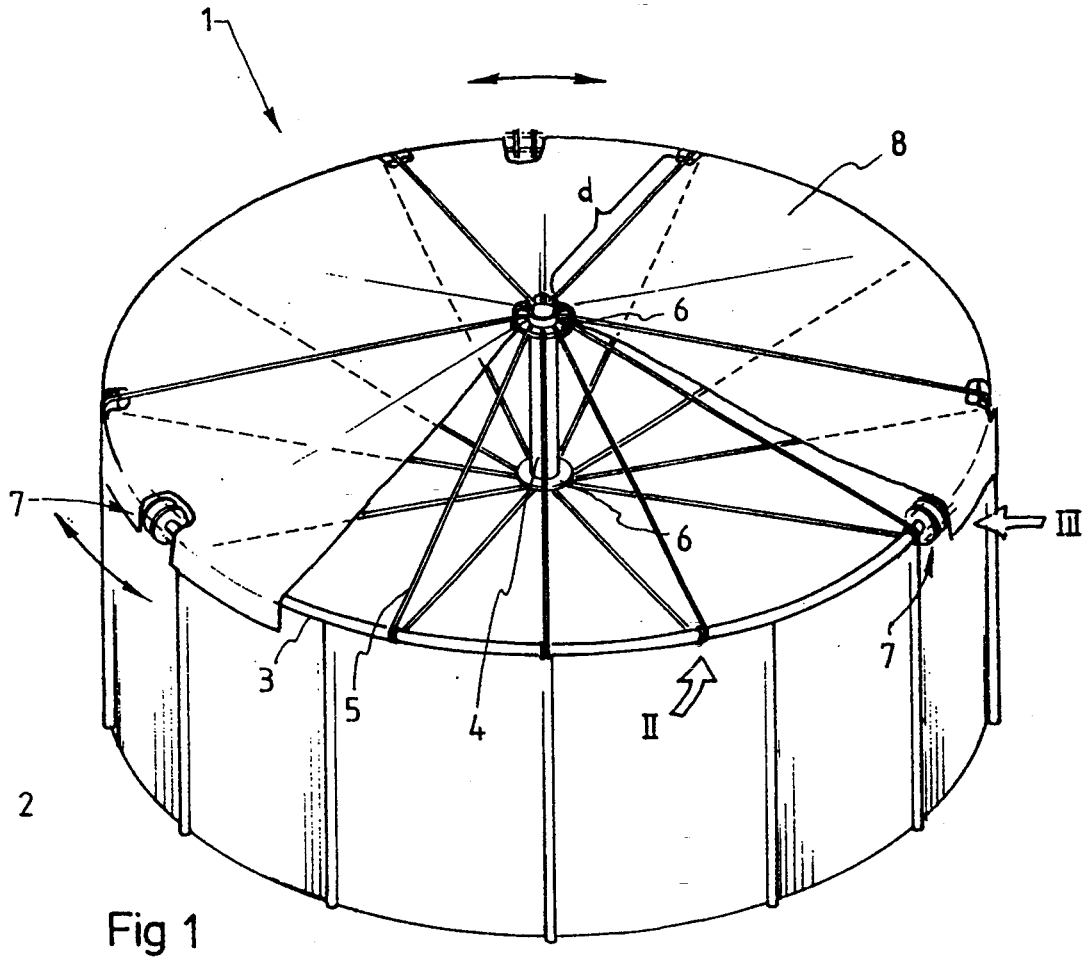
FIG. 1 shows a partially broken away perspective view of a roof according to the invention arranged on a silo.

In FIG. 1 a roof 1 according to the invention is shown arranged on a round silo 2. The silo 2 can be for example a bio-gas holder or a manure storage silo. The roof 1 according to the invention serves to close off the contents of the silo in gas-tight manner from the environment.

The roof 1 comprises a peripheral tube 3 which has the same shape as the silo 2, and in this case is therefore circular.

In the centre the roof 1 comprises a core 4 which consists of a tube having a flange 6 on either side. Arranged between the peripheral tube 3 and the flanges 6 of the central core 4 is a number of tensioning elements 5 in the form of cords or cables or the like. The tensioning elements 5 can be for example of steel wire or a cord of super-strength fibre.

Figure 2:
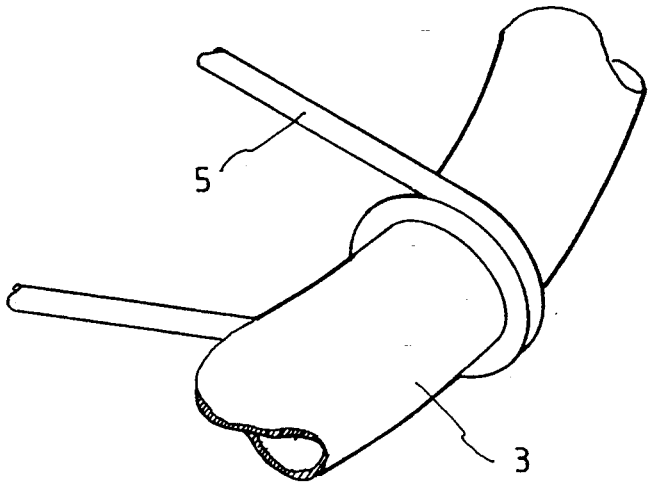
FIG. 2 shows a detail according to the arrow II in FIG. 1.

The tensioning elements 5 are each fastened with their ends to the opposite flanges 6 of the central core 4 and wound around the peripheral element 3, as shown in detail in FIG. 2.

Arranged over the top parts of the tension wires 5 is a piece of sheeting 8 which forms the actual gas-tight closure. The sheeting is fastened to the silo under the edge thereof. The sheeting forms a conical surface to ensure good rainwater drainage.

When mounting the roof 1 according to the invention the peripheral tube 3 and the central core 4 are disposed in the correct positions relative to one another. Thereafter the tensioning elements 5 are arranged. One end is first fastened to a flange 6, after which the element is trained around the peripheral tube 3 and the other end is fixed to the opposite flange 6, for example in a fixed knot. The tensioning elements or tension wires 5 are only pulled tight during assembly and not actually tensioned.

"Central" tensioning means are arranged for tensioning the tensioning elements 5 and therein making a rigid assembly of the whole. These tensioning means can be used to vary, and particularly to enlarge, the distance between the connecting point of the tensioning elements to the peripheral tube 3, that is the location where the tensioning elements are wound round the tube 3, and the connecting position to the central core, that is the connecting position to the flanges 6. In the embodiment shown in FIG. 1 this is achieved in that the peripheral tube is divided at three locations and at the position of these divisions a coupling 7 is arranged wherewith the parts of the peripheral element 3 can be placed at a desired distance. By enlarging the distance the total peripheral length of the peripheral tube 3 is enlarged and thus the distance between the location where the tensioning elements are wound round the tube and the central core.

Figure 3:
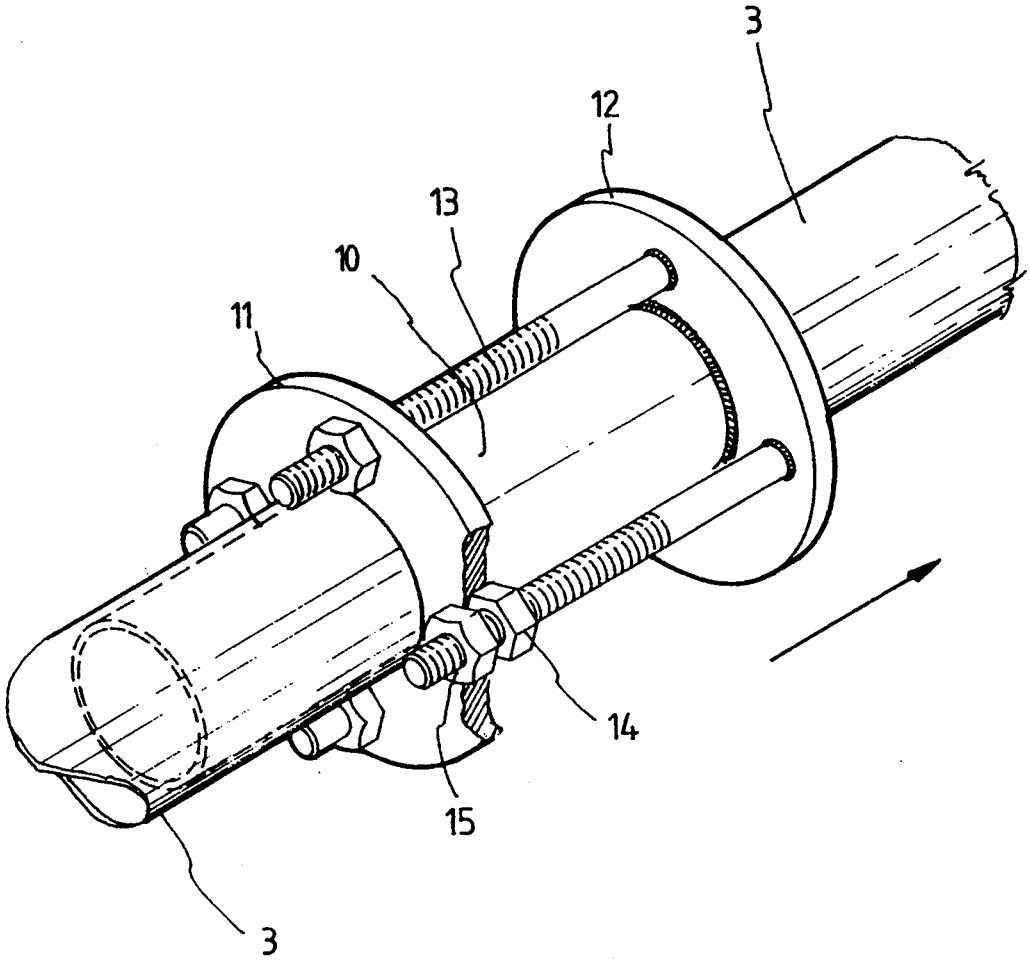
FIG. 3 shows a detail according to arrow III in FIG. 1.

One of the couplings 7 used in the embodiment of FIG. 1 is shown in more detail in FIG. 3. At the point of the division the tube 3 is provided on either side with flanges 11, 12. Welded fixedly to the portion of the tube 3 on the right in FIG. 3 is a sliding tube 10. This has a diameter such that it can slide telescopically into the tube 3. The left-hand portion of the tube 3 can thereby slide telescopically relative to the right-hand portion of the tube 3, wherein the coaxial situation remains preserved.

Welded fixedly to the flange 12 is a number of bolts 13, in the embodiment shown four, which extend to the opposite flange 11 and protrude through borings in this flange. The flange 11 can be constrained away from the flange 12 by rotating in a suitable manner the nuts 14 which lie against the face of the flange 11 facing toward the flange 12. By evenly tightening the nuts 14 the distance between the flanges 11, 12 is thus enlarged and the construction thereby tensioned. As soon as the construction is tensioned to the desired degree, the position reached can be fixed by means of locking nuts 15 which are screwed onto the bolts 13 on the other side of the flange 11.

Figure 4:
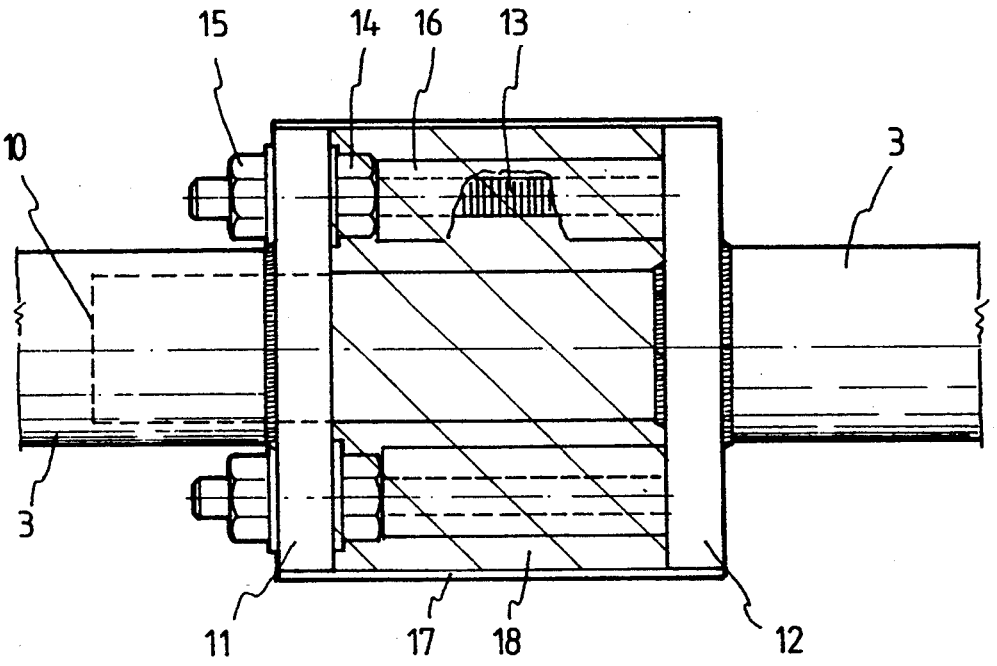
FIG. 4 shows a side view of a finished coupling as shown in FIG. 3.

Once the three couplings 7 of the embodiment shown in FIG. 1 of a roof according to the invention have been suitably tensioned in this manner, and the whole roof construction has therefore become a rigid self-supporting unit, the couplings can be finished in the manner shown in more detail in FIG. 4. A locking sleeve 16 can optionally be arranged around the bolts 13. These locking sleeves 16 are tubular with an opening extending over the whole length with which they can be arranged over the bolts 13. After arranging the sleeves 16, which can be made into the correct length in advance, the nut 14 can be rotated slightly in reverse if required in order to load the sleeve 16. The sleeves 16 form an extra safety precaution against failure of the bolts 13.

A band 17 is then arranged around the two flanges 11, 12, which thus encloses a cylindrical space between the flanges 11, 12. This space is filled with curable foam plastic 18 so that a definitively closed construction is thus obtained that is resistant to the effects of weather.

Instead of constraining the parts of the coupling apart using the bolts, a for instance hydraulic jack can also be employed which engages on the mutually facing sides of the flanges. The flanges are constrained apart by operating the jack. The moved apart position of the flanges can be fixed using a connecting piece having a predetermined length. This connecting piece can for example consist of two half tube portions which are placed around the sliding tube and fixed using a clamping strip or the like. In this case ridges or the like may also suffice instead of the flanges.

Figure 5:
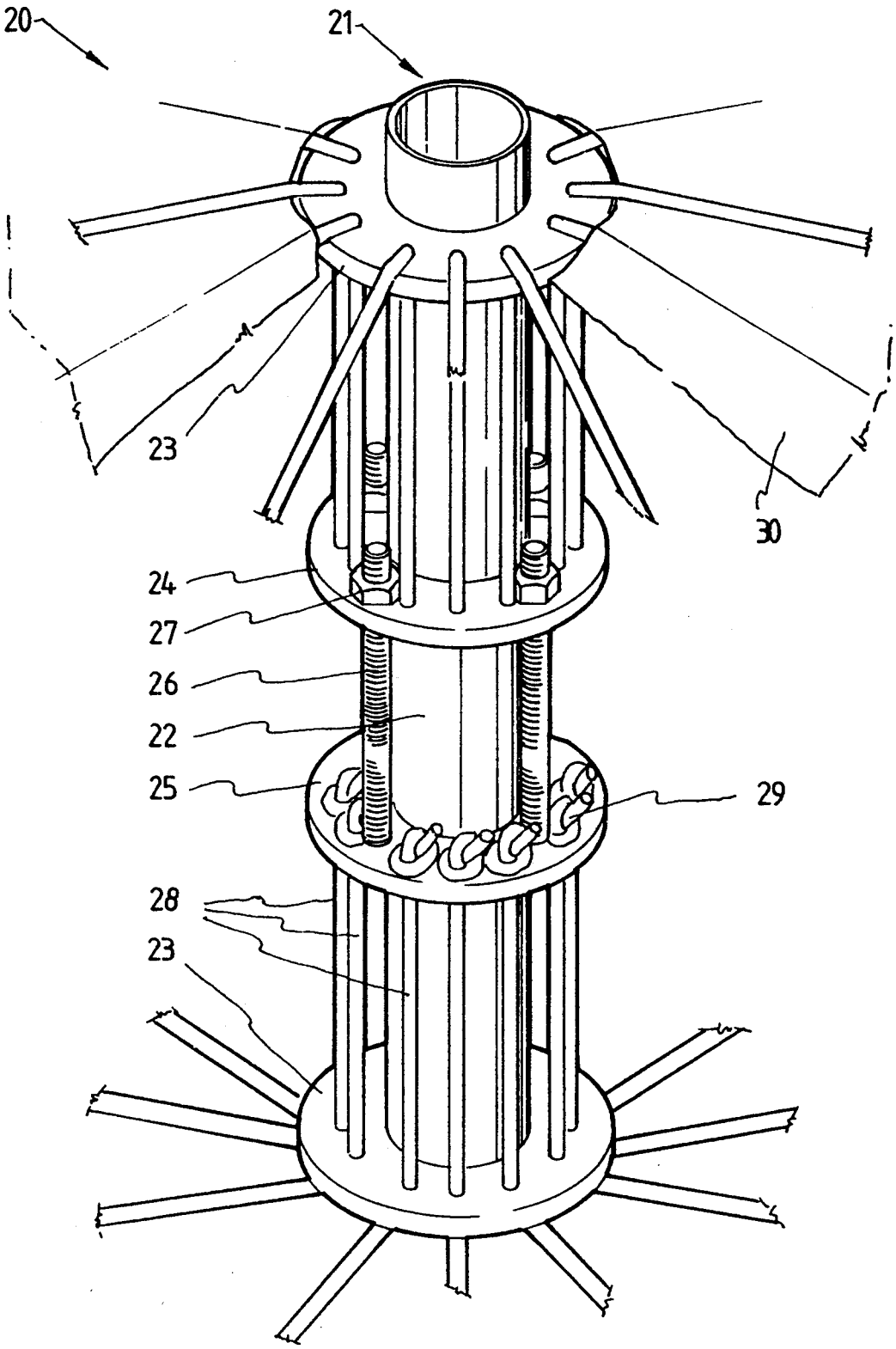
FIG. 5 shows a partially perspective view of another embodiment of the roof according to the invention.

In the embodiment described above with reference to FIG. 1 the tensioning means can vary the distance between the connecting point of the tensioning elements to the peripheral element and the connecting point to the central core in that the length of the peripheral element is enlarged. Instead of this or in combination therewith, this distance can be varied by taking action at the position of the fastening of the tensioning elements close to the central core. An embodiment of the roof according to the invention wherein the tensioning elements are embodied thus is shown in FIG. 5. In this embodiment the peripheral element forms a continuous tube and therefore does not have to be shown further in the drawing.

The central core 21 of the partially shown roof 20 in FIG. 5 consists of a post 22 consisting for example of a piece of tube having a fixedly arranged flange 23 on either end thereof. Two sliding rings 24, 25 are arranged slidably around the post 22 between the flanges 23. The tensioning elements 28 are fixed with their ends to the sliding rings 24, 25 by being placed therein through borings and fixedly knotted 29.

Fixedly welded to the sliding ring 25 is a number of bolts 26, four in the example drawn, which protrude through borings into the opposite sliding ring 24. Nuts 27 are arranged on the ends of the bolts 26 which protrude through the sliding ring 24.

After arranging of the different assembly components the roof 20 can be tensioned by tightening the nuts 27. The sliding rings 24, 25 are hereby pulled towards one another whereby the tensioning elements, in particular tension wires 28, are tensioned.

The sheeting 30 is braided alternately over and under the tensioning elements 28 so that even in unfavourable weather conditions such as violent storm, it is held well in place and does not begin to flap. A gas-tight closure is obtained by arranging a cover over the central core which is joined sealed at one edge to the sheeting 30, for example fixedly glued thereto.

Figure 6:
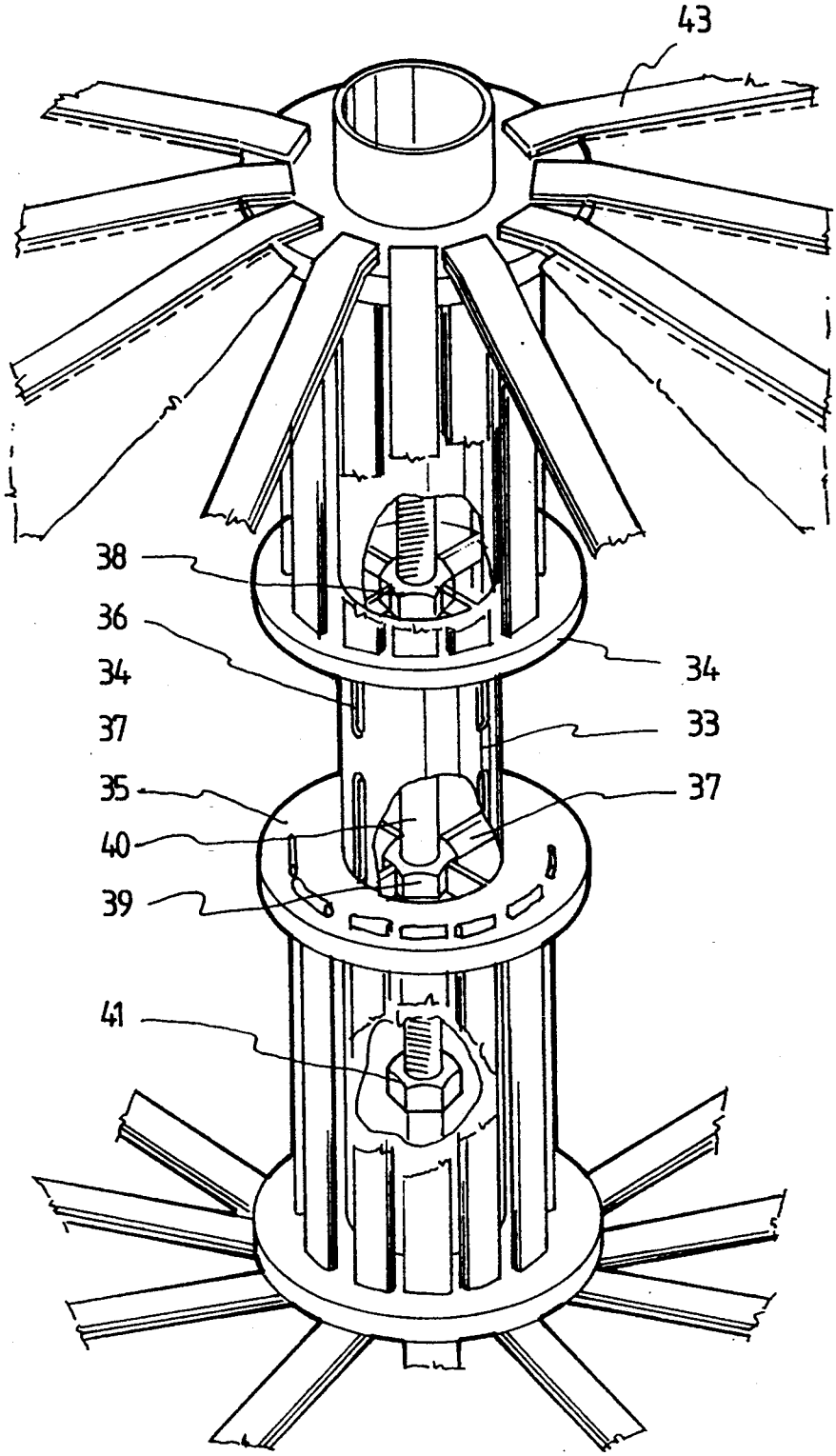
FIG. 6 shows a view corresponding with FIG. 5 of an embodiment variant.

FIG. 6 shows an embodiment partially corresponding to FIG. 5. The slide pieces 34, 35 arranged around the central post are each connected to a nut 38 and 39 respectively by means of cross pieces 37 which protrude through slots 36 in the wall of the post 33. These nuts have opposing screw threads and are in engagement with a screw spindle 40 which is provided with pieces of corresponding screw threading. The screw spindle 40 is provided at the underside with a head 41 onto which a suitable tool can grip to rotate the screw spindle 40. By turning the screw spindle 40 the nuts 38, 39 and thereby the slide pieces 34, 35 are constrained away from or towards each other for tensioning the tensioning elements.

In this embodiment the tensioning elements are formed by bands in place of wires or cords such as in the preceding embodiment. These bands 43 can favourably be of a polyamide. This material can provide the correct tensile force and is moreover well resistent to the danger of the harmful effects of weather influences and chemicals occurring during use. According to a further development the bands can be used in double manner, wherein the sheeting not shown in FIG. 6 is enclosed between the bands. The sealing is again obtained by arranging, for example fixedly glueing, a suitable cover over the region of the central core.

In the embodiments of FIGS. 1, 5 and 6 and as illustrated in FIG. 1, each of the tension elements has (1) a first end attached to a support (6, 24, 34); (2) an intermediate section in contact with a peripheral element 3 and positioned a distance d from the support (6, 24, 34); and (3) a second edge attached to a second support (6, 25, 35) such that the tension of the frame is varied by varying the distance d between the intermediate section and the first support by either varying the length of the peripheral element or the axial distance between the supports.

The constructions described with reference to the figures can be combined in one embodiment and can be modified. The screw spindle of FIG. 6 for example can have at one end an enclosed rotatable connection to the relevant slide piece and engage at the other end in a nut. The screw spindle then only has to carry one sort of screw thread.

The peripheral element, in particular the peripheral tube, can be a round steel tube optionally filled with concrete, in order to achieve a sufficient weight to obtain a good positioning of the roof on the reservoir.

A profile shape other than a round one is of course also possible.

With the embodiment shown in FIG. 1 the roof lies on the top edge of the silo. It is also possible however to give the roof a height-adjustable form wherein on the peripheral tube a number of eyes are for example then arranged which can slide along vertical tubes or poles. A foil apron which hangs down into the liquid can in that case be arranged along the periphery of the roof as gas-tight sealing. A gas-tight water seal is thus formed.

The ends of the tension wires or bands can be fastened in various ways. Wires can for example be fastened by means of a knot in the end, while a pinch connection can also be suitable. The tension wires or bands can also be used endlessly wherein they are threaded in a suitable manner through the supports of the central core and around the peripheral element. The tension wires or bands can be of different material as required in accordance with dimensions, applications and acceptable costs. Suitable materials are steel wires or strips, plastic wires or strips such as the above mentioned polyamide and super-strength fibre such as aramide.

What is claimed is:

1. Roof for a silo comprising:

a frame having a variable tension, said frame having a peripheral element that is adjustable in length, a central core, and a plurality of tension elements, said central core having a first support and a second support mutually connected at an axial distance apart along said central core; said tension elements being distributed about the peripheral element;

wherein each of said tension elements has (1) a first end attached to said first support; (2) an intermediate section in contact with said peripheral element and positioned a distance d from said first support; and (3) a second edge attached to said second support, such that the tension of the frame is varied by varying the distance d between the intermediate section and the first support; and wherein the peripheral element has a circumference that is adjustable in magnitude for varying the distance d between the intermediate section and the first support.

2. The roof of claim 1, wherein the roof further comprises a closing roof covering formed of sheeting, said roof covering placed over the tension elements and affixed to the peripheral element.

3. The roof of claim 1, wherein each of the first and second supports of the central core comprises flanges.

4. The roof of claim 1, wherein said central core further comprises a post and said first support comprises a first flange and said second support comprises a second flange, said first and second flanges being positioned about said post at an axial distance apart from each other, said flanges configured to receive said tension elements.

5. The roof of claim 4, wherein said central core further comprises:

a plurality of adjustable rods, said rods having an upper and a lower end;

at least one upper sliding ring and at least one lower sliding ring, said sliding rings arranged about said post and positioned between said flanges on said post, said sliding rings adapted to receive said tension elements;

wherein said adjustable rods are fitted between said upper and lower sliding rings, and at least one of said sliding rings is adjusted by said rods such that the axial distance between said flanges is variable and the frame has variable tension.

6. The roof of claim 4, wherein said post is at least partially hollow and has a plurality of slots positioned on said post between said first and second flanges.

7. The roof of claim 6, wherein the central core further comprises:

an adjustable threaded spindle, said spindle being received within said post of the central core; and at least one upper sliding ring and at least one lower sliding ring, said sliding rings arranged about said post an axial distance apart and positioned between said first and second flanges on said post, said sliding rings adapted to receive said tension elements;

wherein at least one of said sliding rings is adjustably coupled to said spindle, and said spindle is configured to rotate such that the axial distance between said upper and lower sliding rings is variable and the frame has variable tension.

8. The roof of claim 7, wherein the spindle has a plurality of cross bar elements extending through the slots of said post, and at least one of said sliding rings is adjustably coupled to said spindle by said cross bar elements.

9. The roof of claim 1, wherein said tension elements comprise a polyamide material.

10. Roof for a silo comprising:

a frame having a variable tension, said frame having a peripheral element that is adjustable in length, a central core, and a plurality of tension elements, said central core having a first support and a second support mutually connected at an axial distance apart along said central core; said tension elements being distributed about the peripheral element;

wherein each of said tension elements has (1) a first end attached to said first support; (2) an intermediate section in contact with said peripheral element and positioned a distance d from said first support; and (3) a second edge attached to said second support, such that the tension of the frame is varied by varying the distance d between the intermediate section and the first support; and wherein said peripheral element further comprises a plurality of tubes, and at least one adjustable coupling element, said adjustable coupling element affixed to said peripheral tubes such that the peripheral element has a circumference that is adjustable in magnitude and the frame has variable tension for varying the distance d between the intermediate section and the first support.

11. Roof for a silo comprising:

a frame having a variable tension, said frame having a peripheral element that is adjustable in length, a central core, and a plurality of tension elements, said central core having a first support and a second support mutually connected at an axial distance apart along said central core; said tension elements being distributed about the peripheral element;

wherein each of said tension elements has (1) a first end attached to said first support; (2) an intermediate section in contact with said peripheral element and positioned a distance d from said first support; and (3) a second edge attached to said second support, such that the tension of the frame is varied by varying the distance d between the intermediate section and the first support; and wherein said peripheral element includes a plurality of peripheral tube sections adjustably coupled to one another by a coupling element to form a peripheral element having a circumference that is adjustable in magnitude for varying the distance d between the intermediate section and the first support.

12. The roof of claim 11, wherein each of the plurality of peripheral tube sections has an inner and an outer diameter, each of said peripheral tube sections having at least two ends, and said coupling element having a sliding tube with an outer diameter less than the inner diameter of each of said peripheral tube sections.

13. The roof of claim 12, wherein said coupling elements further comprises:

a plurality of flanges, said flanges fitted about each end of said peripheral tube sections;

a plurality of adjustable rods, said rods fitted between said flanges and about said sliding tube;

wherein said sliding tube is fitted between at least two flanges and dimensioned to slide telescopically into at least one peripheral tube section, and is releasably adjusted by said rods such that the peripheral element has a circumference that is adjustable in magnitude and the frame has variable tension.

14. The roof of claim 13, further comprising a sleeve having an interior cavity, said sleeve fitted about said flanges.

15. The roof of claim 14, wherein the interior cavity of said sleeve is filled with foam plastic.

16. A roof for a storage reservoir comprising:

a frame having an adjustable tension;

said frame having an adjustable central core, a peripheral element, and a plurality of tension elements;

said core having an upper support and a lower support affixed to said core an axial distance apart, wherein said central core further comprises:

a post and said upper support comprises a first flange and said lower support comprises a second flange, said first and second flanges being positioned about said post at an axial distance apart from each other, said flanges configured to receive said tension elements and a plurality of adjustable rods, said rods having an upper end and a lower end; and at least one upper sliding ring and at least one lower sliding ring, said sliding rings arranged about said post and positioned between said flanges on said post, said sliding rings adapted to receive said tension elements; wherein said adjustable rods are fitted between said upper and lower sliding rings, and at least one of said sliding rings is adjusted by said rods such that the axial distance between said flanges is variable and the frame has variable tension;

said peripheral element enclosing said central core and having a length;

each of said tension elements has (1) a first end attached to said upper support; (2) an intermediate section in contact with said peripheral element and positioned a distance d from said upper support; and (3) a second end attached to said lower support;

wherein the tension of the frame is adjusted by varying the distance d for each of said tension elements by varying the axial distance between said flanges.

17. The roof of claim 16, wherein the roof further comprises a closing roof covering formed of sheeting, said roof covering placed over the tension elements and affixed to the peripheral element.

18. The roof of claim 16, wherein said tension elements comprise a polyamide material.

19. A roof for a storage reservoir comprising:

a frame having an adjustable tension;

said frame having an adjustable central core, a peripheral element, and a plurality of tension elements;

said core having an upper support and a lower support affixed to said core an axial distance apart, wherein said central core further comprises:

a post and said upper support comprises a first flange and said lower support comprises a second flange, said first and second flanges being positioned about said post at an axial distance apart from each other, said flanges configured to receive said tension elements; and said peripheral element enclosing said central core and having a length;

each of said tension elements has a first end attached to said upper support; (2) an intermediate section in contact with said peripheral element and positioned a distance d from said upper support; and (3) a second end attached to said lower support;

wherein the tension of the frame is adjusted by varying the distance d for each of said tension elements by varying the axial distance between said flanges and wherein said post is at least partially hollow and has a plurality of slots positioned on said post between said flanges.

20. The roof of claim 19, wherein the central core further comprises:

an adjustable spindle, said spindle being received within said post of the central core element; and at least one upper sliding ring and at least one lower sliding ring, said sliding rings arranged about said post an axial distance apart and positioned between said flanges on said post, said sliding rings adapted to receive said tension elements;

wherein at least one of said sliding rings is adjustably coupled to said spindle, and said spindle is configured to rotate such that the axial distance between said upper and lower sliding rings is variable and the frame has variable tension.

21. The roof of claim 20, wherein the spindle has a plurality of cross bar elements extending through the slots of said post, and at least one of said sliding rings is adjustably coupled to said spindle by said cross bar elements.

22. The roof for a storage reservoir comprising:

a frame having an adjustable tension;

said frame having an adjustable peripheral element, a central core, and a plurality of tension elements;

said adjustable peripheral element having an adjustable peripheral length;

said central core having an upper support and a lower support affixed to said core an axial distance apart;

each of said tension elements has (1) a first end attached to said upper support; (2) an intermediate section in contact with said peripheral element and positioned a distance d from said upper support; and (3) a second end attached to said lower support;

wherein the peripheral length of the peripheral element adjusts the distance d for each tension element thereby varying the tension of the frame.

23. The roof of claim 22, wherein the roof further comprises a closing roof covering formed of sheeting, said roof covering placed over the tension elements and affixed to the peripheral element.

24. The roof of claim 22, wherein said upper support comprises a first flange and said lower support comprises a second flange.

25. The roof of claim 22, wherein said peripheral element further comprises a plurality of peripheral tube sections, and at least one adjustable coupling element affixed to said plurality of peripheral tube sections.

26. The roof of claim 25, wherein each of the plurality of peripheral tube sections has an inner and an outer diameter, each of said peripheral tube sections has at least two ends, and each of said coupling elements has a sliding tube with an outer diameter less than the inner diameter of each of said peripheral tube sections.

27. The roof of claim 26, wherein each of said coupling elements further comprises:

a plurality of flanges fitted about each end of said peripheral tube sections; and a plurality of adjustable rods fitted between said flanges and about said sliding tube;

wherein said sliding tube is fitted between at least two flanges and dimensioned to slide telescopically into at least one peripheral tube section, and is releasably adjusted by said rods such that the peripheral length of the peripheral element is adjusted and the tension of the frame is varied.

28. The roof of claim 27, further comprising a sleeve having an interior cavity, said sleeve fitted about said flanges.

29. The roof of claim 28, wherein the interior cavity of said sleeve is filled with foam plastic.

30. The roof of claim 22, wherein said tension elements comprise a polyamide material.

* * * * *

UNITED STATES PATENT AND TRADEMARK OFFICE

CERTIFICATE OF CORRECTION

PATENT NO. : 5,444,943

DATED : August 29, 1995

INVENTOR(S) : Hendrik W. Schelfhorst

It is certified that error appears in the above-indentified patent and that said Letters Patent is hereby corrected as shown below:

Col. 7 In claim 13, lines 1-2, delete "ele-ments" and substitute --element--.

Col. 9 In claim 19, line 17, after "has" insert --(1)--.

In claim 20, line 4, delete "element".

Signed and Sealed this

Second Day of July, 1996

Bruce Lehman

*Attest:*

BRUCE LEHMAN

*Attesting Officer*

*Commissioner of Patents and Trademarks*